US007396154B2

(12) United States Patent
Houlon

(10) Patent No.: US 7,396,154 B2
(45) Date of Patent: Jul. 8, 2008

(54) REGULATING ELEMENT FOR WRISTWATCH AND MECHANICAL MOVEMENT COMPRISING ONE SUCH REGULATING ELEMENT

(75) Inventor: Thomas Houlon, Boudry (CH)

(73) Assignee: TAG Heuer SA, La Chaux-de-Fonds (CH)

( * ) Notice: Subject to any disclaimer, the term of this patent is extended or adjusted under 35 U.S.C. 154(b) by 0 days.

(21) Appl. No.: 11/789,817

(22) Filed: Apr. 26, 2007

(65) Prior Publication Data

US 2007/0201317 A1 Aug. 30, 2007

Related U.S. Application Data

(63) Continuation of application No. PCT/EP2005/055582, filed on Oct. 26, 2005.

(30) Foreign Application Priority Data

Oct. 26, 2004 (CH) ..... 1768/04

(51) Int. Cl.
*G04B 15/00* (2006.01)
*G04B 17/00* (2006.01)
*G04F 5/00* (2006.01)

(52) U.S. Cl. ..... 368/127; 368/163; 368/169

(58) Field of Classification Search ..... 368/124–131, 368/161–164, 169–171
See application file for complete search history.

(56) References Cited

U.S. PATENT DOCUMENTS

| | | | | |
|---|---|---|---|---|
| 3,161,012 | A | 12/1964 | Hug et al. | |
| 3,524,118 | A * | 8/1970 | Reich | 318/128 |
| 3,626,691 | A * | 12/1971 | Bonsack | 368/169 |
| 3,665,699 | A | 5/1972 | Challandes | |
| 3,670,492 | A * | 6/1972 | Takamune et al. | 368/169 |
| 3,714,773 | A | 2/1973 | Diersbock | |
| 3,813,372 | A * | 5/1974 | Nakagawa et al. | 526/234 |
| 3,851,461 | A | 12/1974 | Tilse | |
| 3,921,386 | A | 11/1975 | Keller | |
| 3,937,001 | A | 2/1976 | Berney | |
| 4,266,291 | A | 5/1981 | Obata et al. | |
| 2003/0137901 | A1 | 7/2003 | Tokoro et al. | |

FOREIGN PATENT DOCUMENTS

| | | |
|---|---|---|
| DE | 24 24 212 A1 | 11/1975 |
| EP | 1 521 142 A1 | 4/2005 |
| GB | 1 444 627 A | 8/1976 |

OTHER PUBLICATIONS

International Search Report Dated Jun. 29, 2006.

* cited by examiner

*Primary Examiner*—Vit W Miska
(74) *Attorney, Agent, or Firm*—Pearne & Gordon LLP

(57) ABSTRACT

Regulating element for wristwatch comprising: a balance, a magnetic return member for returning the balance to at least one stable equilibrium position, and an escapement for maintaining the oscillation of the balance around the equilibrium position.

49 Claims, 12 Drawing Sheets

REGULATING ELEMENT FOR WRISTWATCH AND MECHANICAL MOVEMENT COMPRISING ONE SUCH REGULATING ELEMENT

RELATED APPLICATIONS

The present application is a continuation of international application PCT/EP2005/055582 (WO2006/045824) filed Oct. 26, 2005, the content of which is included by reference, and which claims priority of Swiss patent application 2004CH-01768 of Oct. 26, 2004, the content of which is included by reference.

TECHNICAL FIELD

The present invention concerns a regulating element for wristwatch and a mechanical movement comprising one such regulating element.

STATE OF THE ART

Usual mechanical watches comprise an energy accumulator constituted of a barrel, a cinematic chain, or gear train, driving the hands, a regulating element determining the running of the watch as well as an escapement for transmitting the oscillations of the regulating element to the gear train. The present invention concerns in particular the regulating element.

Conventional regulating elements usually comprise a balance mounted on a rotating axle and a return member exerting a torque on the balance to return it towards an equilibrium position. The escapement, or driving element, maintains the barrel's oscillations around the equilibrium position. The return member generally includes a spiral spring, often called spiral, mounted coaxially to the balance. The spiral transmits a return torque to the balance through the collet; the resting position of the spiral spring determines the return position of the balance.

This widely spread arrangement, however, has certain disadvantages.

Firstly, the matter deformation at each oscillation of the spiral spring causes a loss of energy and thus a reduction of the watch's running time. On the other hand, the watch's accuracy depends for a large part on the properties of the material used for the spiral spring as well as on the machining precision of the terminal curves. Despite considerable progress in metallurgy, the reproducibility of these properties is difficult to guarantee. Furthermore, spiral springs tend to tire with time, so that the return force diminishes as the watch ages, which causes the accuracy to vary.

Furthermore, the balance's oscillations in one direction, for example clockwise, tend to uncoil the spiral spring whilst rotations in the other direction conversely have the effect of contracting it. The spring's deformation thus occurs differently depending on the direction of rotation of the balance, which influences the return force and thus the accuracy and reproducibility.

The balance-spring stud and the collet enabling the spiral to be fastened to the balance-cock (or balance bridge), respectively to the balance, constitute other sources of perturbations and an unbalance that unpoise the balance. On the other hand, the spiral exerts a torsion torque on the balance on the point of fastening to the collet, which influences negatively the achieved precision. In vertical position, the spiral further tends to deform under its own weight, which causes a displacement of its center of gravity and a perturbation of the period.

Moreover, the balance is also subjected to gravitational force as well as to accelerations caused by the wearer's movements. The spiral spring's return force being not very important, these external perturbations have a considerable influence on the running accuracy, and complex correction mechanisms, for example tourbillons or even three-axes tourbillons, are sometimes used to compensate them.

Further, the thickness of the spiral adds to that of the balance, so that the total thickness of the regulating member is relatively great.

Regulating members for wristwatches that use a vibrating tuning-fork have been conceived, which allow a number of the mentioned problems to be solved. These regulating member, however, also act by elastic matter deformation and vibration in the tuning-fork's branches, so that the accuracy in this case also depends on the metallurgy and on the machining precision. These solutions have not prevailed on a wide scale.

Regulating members of highly varied construction have also been conceived in clocks, grand-father clocks, or other large size horological devices. The available volume, and the fixed vertical position, allow for example the gravitational force to be used to return a balance or pendulum towards its position of equilibrium. The miniaturization and the considerable accelerations impressed to the conventional mechanical watch movements however dissuade watch makers from transposing the solutions used for clocks or grand-father clocks to movements for wristwatches.

AIMS OF THE INVENTION

One aim of the present invention is thus to propose a regulating member for wristwatch that is different and that avoids the disadvantages of the prior art.

Another aim is to propose a regulating member capable of being used with a mechanical watch, deprived of electric power source.

Another aim of the invention is to propose a regulating member with a balance for mechanical watch that does not have a balance-cock, a balance-spring stud, a collet and other means for fastening the return member to the balance and to the balance axle.

According to the invention, these aims are achieved by means of a regulating member having the characteristics of the main claim, preferred embodiments being indicated in the dependent claims.

These aims are achieved notably by means of a regulating member for mechanical wristwatch, having:

a balance, a return member for returning said balance towards at least one position of equilibrium, a driving element for maintaining the balance's movement around said position of equilibrium, said balance being linked to at least one mobile permanent magnet, and said return member having at least one fixed permanent magnet for generating a magnetic field in order to return said balance towards said position of equilibrium.

This arrangement has the advantage of allowing the spiral spring, and most of the problems associated thereto, to be completely avoided in mechanical watches.

This arrangement also has the advantage of providing superior precision as well as less influence to the perturbations caused by gravitation or by external accelerations.

In one embodiment, the return member tends to return the balance towards at least one stable position of equilibrium whose driving element, for example an escapement, tends to move it away from.

Oscillating members using magnetic fields are notably described in U.S. Pat. Nos. 4,266,291, 3,921,386, 3,714,773, 3,665,699, 3,161,012, DE2424212 and GB1444627. These seven documents however concern electric watches, in which a magnetic field is generated by means of an electro-magnet. These solutions are thus not adapted to mechanical watches that do not have an electric power source.

The additional document US2003/0137901 describes a mechanical watch movement in which the balance is provided with permanent magnets. The rotating field caused by the oscillations of the balance is detected by a running control mechanism in order to control the variations in the balance's oscillations. These oscillations are however caused by a conventional spiral spring, with all the above-mentioned disadvantages.

The aims of the invention are also achieved by means of a regulating member for mechanical wristwatch, having:

a balance, a return member for returning said balance towards at least one stable position of equilibrium, a driving element for maintaining the balance's movement around said position of equilibrium, wherein said return member acts without contact with said balance.

The advantage is notably to limit the perturbations caused by the torsion torque at the point of fastening of the spiral to the balance.

In a preferred embodiment of the invention, the magnetic field generated by the fixed part of the return member is fixed and constant, i.e. it does not turn and does not vary in time.

In a preferred embodiment, the magnetic field generated by the mobile magnet or magnets turns; this means that the balance has a rotation axle and that the mobile magnet or magnets, which are fixedly united with the balance onto which they are directly fastened, oscillate along a circular trajectory around said rotation axle. The number of mobile parts is thus reduced and translation movements, that generate greater friction, are avoided. Furthermore, the totality of the cinematic energy of the mobile magnets is transmitted to the balance. Furthermore, the balance's rotation movements can be transmitted by means of a conventional escapement to the rest of the watch. The balance's movement is thus constituted by oscillations around the rotation axle of the balance, with the amplitude of the oscillations being less than 360°, for example less than 180° or even less than 120°. It is thus possible to achieve a considerable oscillation frequency, which is advantageous for the precision and resolution of the regulating member; furthermore, it is easier to achieve a relation without discontinuities between the return force and the angular position of the balance when the latter oscillates in a limited interval. The invention is however not restricted to specific oscillation amplitudes; oscillation amplitudes between 180 and 300°, or even amplitudes close to 360°, can also be used, for example by using a single fixed magnet and a single mobile magnet. These oscillations of greater amplitude have the advantage of minimizing the impact of the perturbation introduced by the escapement at each cycle.

Preferably, at least one mobile magnet oscillates along a circular trajectory between two fixed permanent magnets placed on an arc of circle and spaced angularly by less than 180°. By moving the fixed permanent magnets closer in this manner, a considerable magnetic interaction is created whose intensity varies according to a continuous function along the oscillation trajectory.

In a preferred embodiment of the invention, the balance is excited by mechanical elements to oscillate in isochronous manner around the position of equilibrium. Advantageously, the balance can thus be associated to a standard escapement for mechanical watch. Alternatively, the energy required for exciting the balance can be transmitted from the escapement through permanent magnets. Thus, the inventive magnetic balance can be used in a purely mechanical watch that does not have coils, electromagnets and an electric power source.

In a preferred embodiment, the mobile magnet or magnets are fixed relative to the balance, which makes the construction easier. The balance and the magnets thus oscillate according to the same alternated circular movement.

The fixed magnets preferably act so as to push back the mobile magnets mounted on the balance. The position of equilibrium is determined by repulsion forces and is reached when the mobile magnets are at equidistance between two fixed magnets and the repulsion force of the two fixed magnets acting on each mobile magnet is compensated. The magnetic field generated by the fixed magnets is thus minimal at the position of equilibrium, so that the quantity of energy necessary for moving the balance away from this position of equilibrium and for maintaining an oscillation is reduced. The magnetic interaction between the fixed and mobile magnets increases as the balance moves away from the position of equilibrium, so that the return force increases proportionally with the angular distance of the balance relative to its resting position.

The stability of the point of equilibrium can however be controlled by additional magnets acting through attraction. Similarly, the balance can be moved away from equilibrium positions that are not desirable.

The invention does not exclude variant embodiments in which the position of equilibrium is determined by attraction forces and is achieved when the mobile magnets are at minimum distance of corresponding fixed magnets or at equidistance between two fixed magnets whose attraction forces compensate one another. This embodiment has however the disadvantage of requiring a greater excitation to make the balance oscillate around a position of equilibrium corresponding to a maximum of the magnetic attraction.

In one embodiment, the magnetized parts are constituted by magnetized portions of the balance itself. The balance could thus be constituted of a magnetized ring with alternating polarities along its periphery.

In another embodiment, the mobile magnets are directly mounted on or linked to the pallets of the escapement. The pallets then constitute a balance, i.e. an element oscillating in isochronous fashion in a magnetic field.

BRIEF DESCRIPTION OF THE DRAWINGS

The invention will be better understood by reading examples of embodiments illustrated by the attached figures, which show.

EMBODIMENT(S) OF THE INVENTION

In the following description and in the claims, the adjective "fixed" always refers to the movement. An element is fixed if it does not move relative to the movement, for example relative to the movement's bottom plate.

The term "balance" designates a part oscillating under the effect of an excitation around a position of equilibrium. The more or significantly isochronous oscillations determine the running of the watch. The balance can be constituted by a wheel with any number of spokes, a disc, a rod, pallets, etc.

Figure 1A:
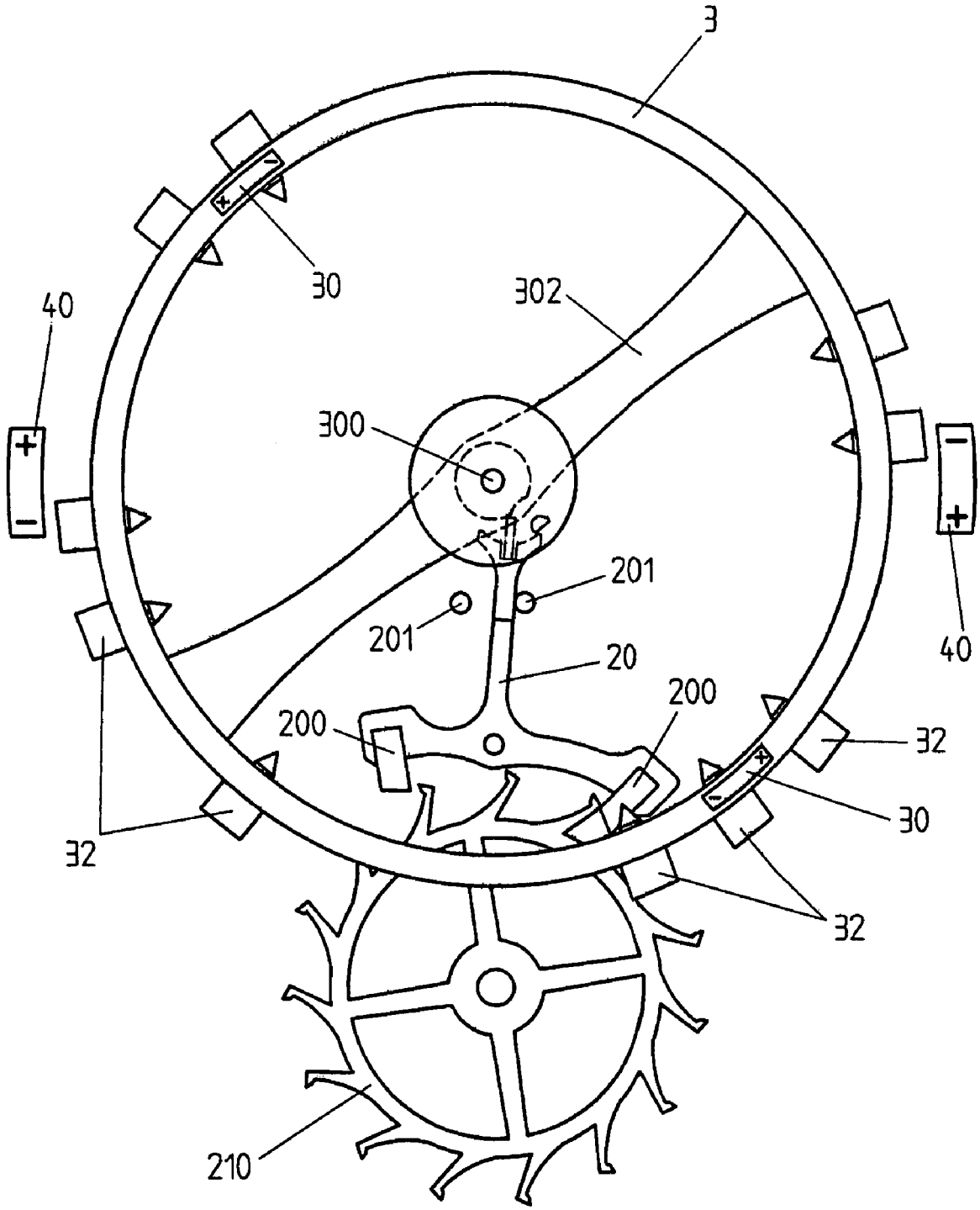
FIG. 1*a*, a diagrammatic top view of a first embodiment of a regulating member according to the invention.
Figure 1B:
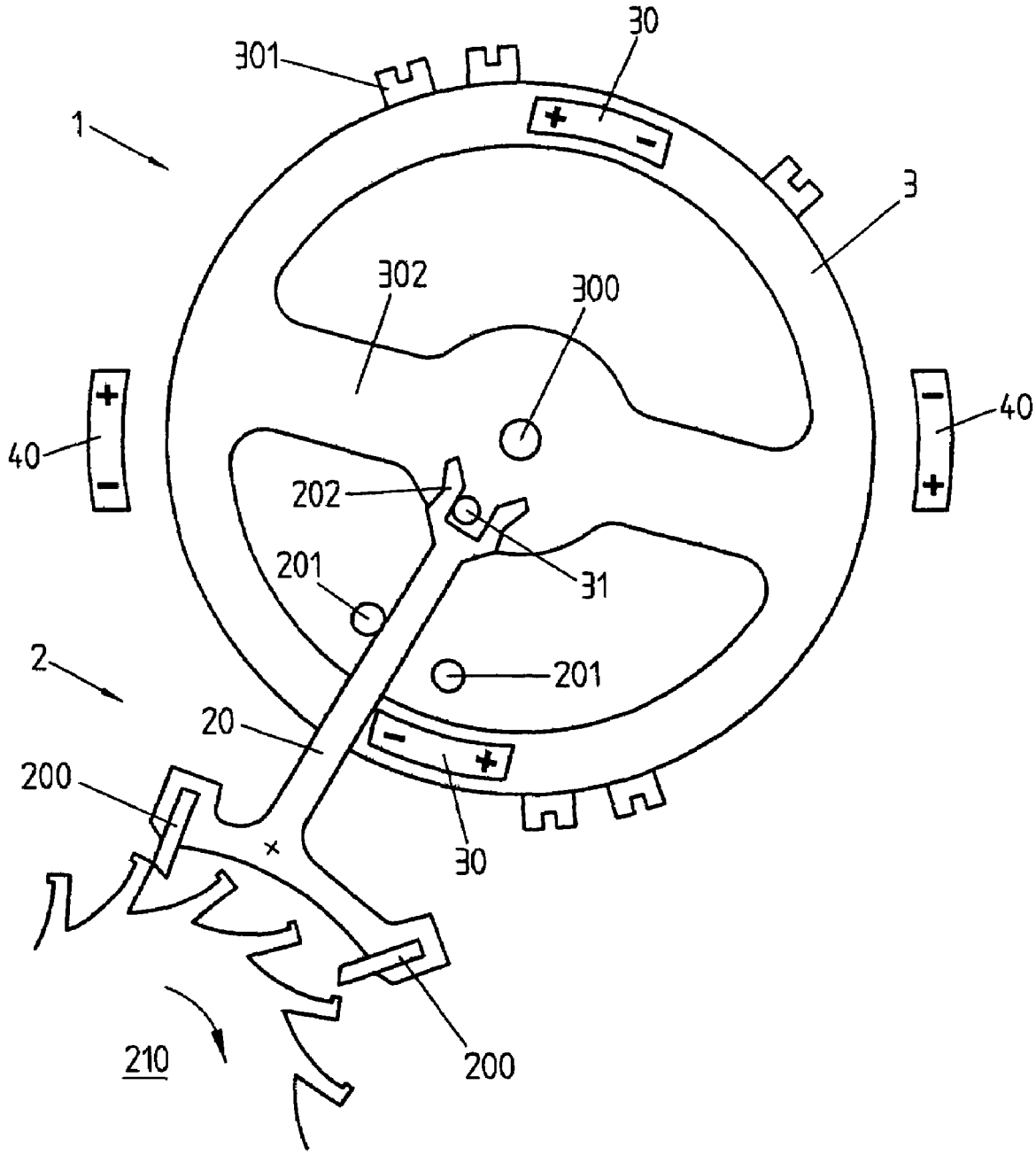
FIG. 1*b*, a diagrammatic top view of a first embodiment of a regulating member according to the invention, with the balance being in the position of equilibrium defined by the magnets.

FIG. 1*b* illustrates diagrammatically a regulating member 1 having a balance 3 oscillating around an axle 300 perpendicular to the movement's bottom plate. In this example, the balance 3 has an annular felloe and has two radial spokes (or arms) 302 around the axle 300. Screws 301 allow the balance's inertia moment to be moved easily. The balance constitutes an inertia mass; its mass, as well as its radius, are preferably considerable within the limits set by the will to miniaturize the movement. The considerable return force afforded by the claimed solution allows particularly considerable inertia masses to be used.

Bi-metallic balances that deform to compensate temperature variations are also possible within the frame of the invention. Other means can be used to compensate the variation in intensity of the magnetic field related to the temperature.

The balance 3 is linked with or provided with mobile permanent magnets 30 driven in rotation with the balance. The illustrate example has two discrete bipolar permanent magnets that are placed symmetrically relative to the axle 300, at 180° from one another. Each magnet has a positive pole and a negative pole at equidistance to the axle 300. The magnets 30 can be held mechanically or by gluing on the balance 3. As indicated, the magnetized parts could also be constituted by magnetized portions of the balance itself or by a magnetic path on the balance. The balance could thus be constituted of a magnetized ring with alternating polarities along its periphery. The balance could for example be magnetized in a homogenous or progressive fashion by means of a recording head, i.e. a coil generating a magnetic field of controlled intensity in a head gap.

The regulating member further has two fixed permanent magnets 40 mounted on a bridge or on the bottom plate of the movement by any adapted means. The two magnets are placed in the plane of the balance 3, symmetrically and at 180° relative to the axle 300. In an embodiment not represented, the fixed magnets 40 could also be placed in another plane, parallel to the plane of the balance 3. The magnets 40 each have a positive pole and a negative pole whose arrangement, symmetrical relative to the axle 300, is nevertheless inverted relative to the arrangement of the poles on the mobile magnets 30. Thus, the fixed magnets 40 and the mobile magnets 30 push each other back with a maximum magnetic interaction force when they are close. The position of equilibrium is reached by turning the balance by 90° so as to push back each mobile magnet 30 to equidistance of the two fixed magnets 40; the magnetic field generated by the permanent magnets 40 is minimal in this arrangement so that the force or moment necessary for leaving this position of equilibrium is also reduced.

The magnets 30 and 40 are preferably chosen so that the magnetic repulsion force, even in the illustrated position of equilibrium, is much greater than the gravitational force exerted on the balance 3. Permanent magnets made of metallic oxides, or rare earth compounds or of platinum-cobalt alloys will preferably be used to obtain considerable residual fields.

The position of the fixed magnets, or even the position of the mobile magnets, can be adjusted in all embodiments, for example by means of screws, in order to regulate the balance's oscillation frequency.

The balance's oscillations thus depend little on the balance's inclination. The revolving mass of the balance 3 (including the screws 301) and of the mobile magnets 30 is further preferably spread as regularly as possible around the axle 300, so as to improve the balance's equilibrating.

In all embodiments, additional mechanical stops, not represented, can be provided on the balance 3 and/or on a bridge in order to limit the amplitude of the balance's possible rotations and thus prevent the balance from switching from one position of equilibrium to another following a shock for example. Similar stopper elements can also be used with the other embodiments discussed further below. Additional stops can for example include elastic means to dampen the shocks at the end of travel.

The balance 3 is made to oscillate around the position of equilibrium of FIG. 1*b* by means of a driving element constituted in this example by an escapement 2, here a conventional Swiss pallets escapement 20. The escapement can also be specially adapted to take into account the balance's low amplitude of oscillation.

An escapement wheel 210 driven by the barrels (not represented) or by another suitable source of mechanical energy actuates the pallets 20 through ruby pallet-stones 200. The displacements of the pallets, limited by the stops 201, are transmitted to the balance 2 through the fork 202 and the peg 31.

Other types of escapements, including electric or magnetic escapements, can be used within the frame of the invention. In a magnetic escapement, the pulses given to the balance 30 are preferably so by attraction or repulsion between magnetized parts on the balance and on the escapement. It is thus possible to drive without contact.

The amplitude and frequency of the oscillations around the position of equilibrium are determined by the force and the arrangement of the magnets and by the amplitude of the torque transmitted by the driving element. It will furthermore be noted that the balance 30 oscillates without matter deformations, so that the oscillation frequency does not depend on the metallurgic characteristics or on the aging of elastic parts.

The considerable return force afforded by the use of powerful magnets allows considerable oscillation frequencies to be achieved, greater than the usual frequencies in common mechanical watches, and thus the movement's precision and/or resolution to be increased. A choice of suitable magnets and geometry thus allows time or duration indications to be displayed with a resolution on the order of the tenth or even hundredth of a second.

Figure 2:
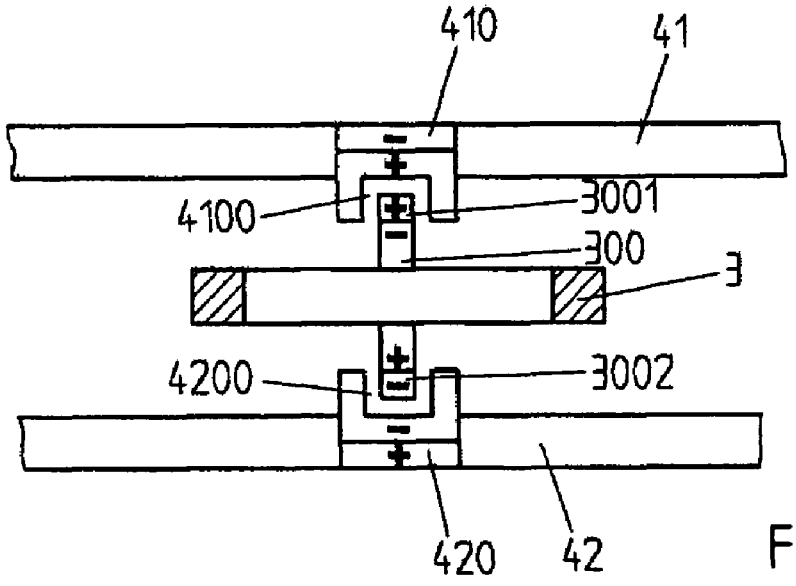
FIG. 2, a cross-section view of the regulating member according to the first embodiment of the invention, having in this example two magnetic bearings and a magnetic screen.

The regulating member of FIG. 1*b* is represented in partial cross-section in FIG. 2, where the escapement 2 has been removed from the figure to improve readability. In the illustrated embodiment, the balance 3 pivots around an axle 300 perpendicular to the upper bridge 41 and to the lower bridge 42. The bridges 41 and 42 preferably form a magnetic screen allowing both the balance 3 to be protected from external magnetic field and the other components of the watch to be protected by the magnetic fields generated notably by the magnets 30 and 40. A screen can also, in an embodiment that is not represented, be achieved through elements distinct from the bridges, for example by means of the bottom plate, the dial, the case or dedicated elements. A screen an all sides can also be adopted. On will furthermore preferably use a movement of which at least certain axles, pinions, wheels and/or bridges are made of non-magnetic materials. In a preferred embodiment, the cinematic chain between the regulating member and the hands has at least one element of synthetic material, for example a belt driven by a pulley.

The axle 300 of the balance 2 is held in the bridges 41, 42 by means of two bearings 410 and 420, for example conventional shockproof bearings, Incabloc bearings or, in the preferred embodiment that is illustrated, magnetic bearings. In this example, the upper extremity 3001 and lower extremity 3002 of the axle 300 are magnetized or provided with magnets. The bearings 410 resp. 420 each have a lodging 4100 resp. 4200 whose depth and diameter are slightly greater than the corresponding dimensions of the axle 300. The sides of the lodgings are magnetized with a polarization identical to that of the corresponding extremities of the axle 300, so as to push this axle back so that it is thus held in levitation between the bearings 410 and 420. The axle 300 can thus pivot without friction. This arrangement further allows the wear of the bearings 410, 420 and of the axle 300 to be avoided.

The balance 3 of the invention can thus oscillate without any contact with other elements, being returned to its position of equilibrium by means of the magnets 30, 40 held by the magnetic bearings 410, 420 and/or driven by a magnetic escapement. It is thus possible to reduce friction and wear caused by the balance's movements. These different measures can however be used independently from one another.

FIG. 1*b* illustrates a variant embodiment of regulating member similar to the embodiment of FIG. 1*b*, but wherein the design of the escapement allows oscillations of the balance of greater amplitude, for example oscillations of 180° maximum, or even more by modifying the arrangement of the magnets. The escapement is preferably a Swiss pallets escapement that allows the balance to oscillate considerably without generating excessive oscillations of the pallets. The balance 3 is further provided with screws allowing possible unbalances or other sources of running perturbations.

The geometry of the balance described in relation with FIGS. 1*a*, 1*b* and 2 is similar to that of the balances of conventional mechanical regulating members. Use of a magnetic return member allows however different constructions of balances 3 to be conceived, of which several examples will be described in relation with FIGS. 3 to 13 notably.

Figure 3:
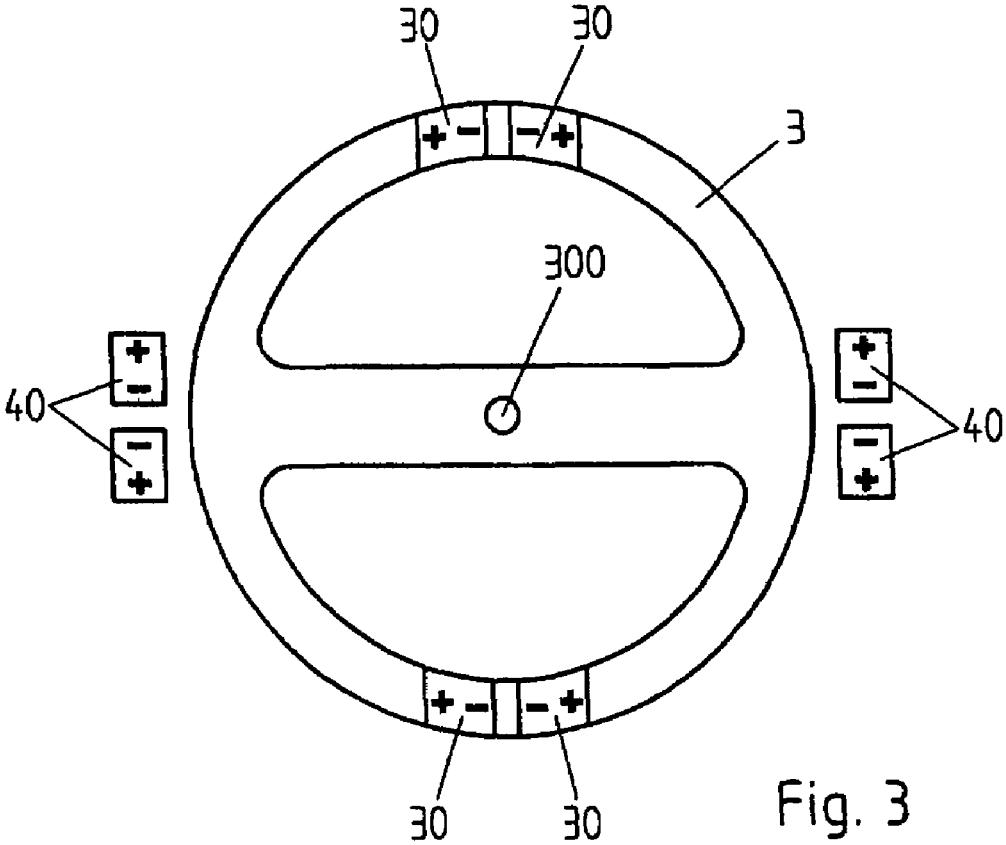
FIG. 3, a top view of an embodiment of a regulating member according to the invention, having fixed magnets and mobile magnets each constituted of two bipolar magnets joined side-by-side in opposition.
Figure 4:
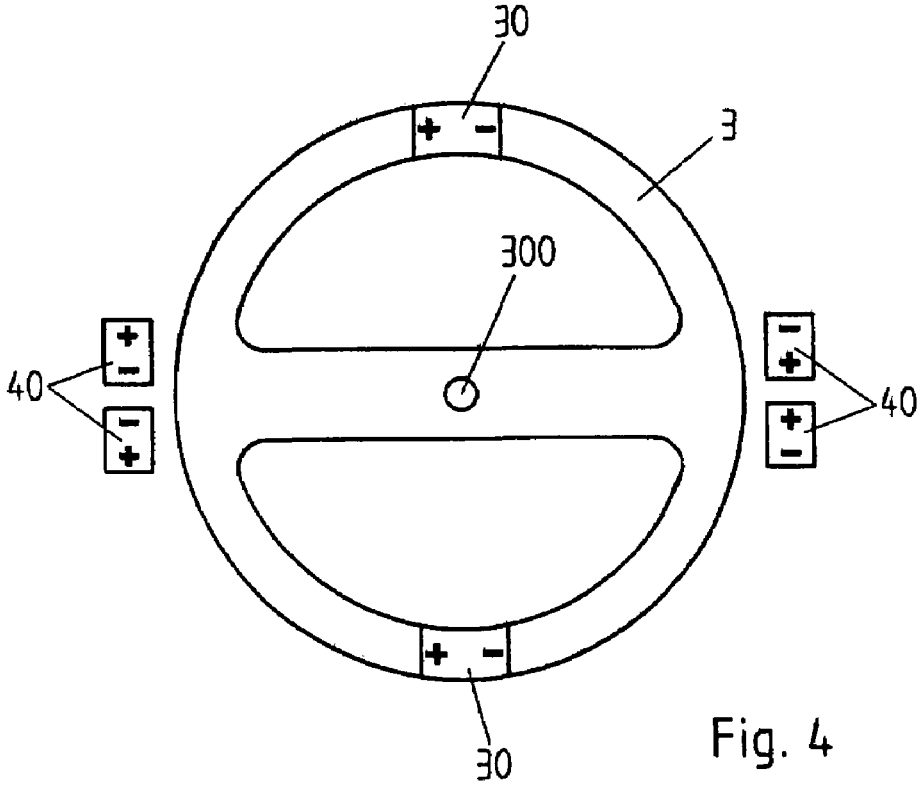
FIG. 4, a top view of an embodiment of a regulating member according to the invention, having fixed magnets each constituted of two bipolar magnets joined side-by-side in opposition, and mobile magnets constituted each of a single bipolar magnet.

FIG. 3 illustrates in a simplified manner a second embodiment of regulating member according to the invention (without the escapement 2), wherein the fixed permanent magnets 40 and the mobile permanent magnets 30 are each constituted by two magnets joined side-by-side in opposition. The resulting magnetized part thus comprises two extremities provided with identical polarities. The two mobile magnets 30 on the balance 3 are however constituted each of a bipolar magnet, the whole having a horizontal symmetrical axis.

Figure 5:
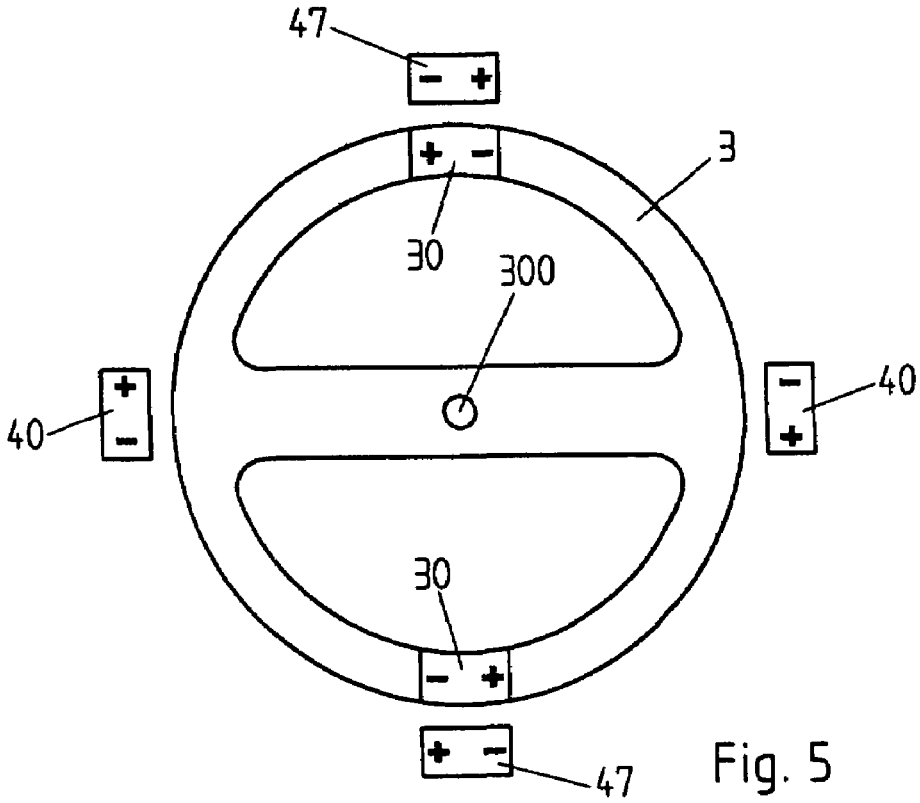
FIG. 5, a top view of an embodiment of a regulating member according to the invention, having additional magnets to increase locally the stability of the point of equilibrium.

FIG. 5 illustrates in a simplified manner a fourth embodiment of the invention, corresponding to FIG. 1 but wherein additional fixed permanent magnets 47 are placed opposite mobile magnets 30 at the position of equilibrium. In the example illustrated, the additional fixed magnets 47 and the mobile magnets 30 attract mutually at the position of equilibrium. The position of equilibrium is thus determined both by the repulsion of the magnets 30 and 40 and by the attraction of the magnets 30 and 47; the contribution of the repulsion forces is however dominant so as to limit the stability of the point of equilibrium and to allow the system to oscillate even with a low driving energy. The magnetic field generated by the additional fixed magnets 47 is thus preferably greatly less than the magnetic field of the magnets 40.

Additional magnets 47 with inverted poles, so as to reduce the stability of the point of equilibrium, can also be conceived within the frame of the invention.

Similar results can be achieved by placing additional permanent magnets on the balance.

Additional magnets can also be provided at the end of travel, either on a bridge or on the balance, so as to attract or repulse the balance in this position and to reduce the variation of amplitude of the oscillations caused by perturbations.

Figure 6:
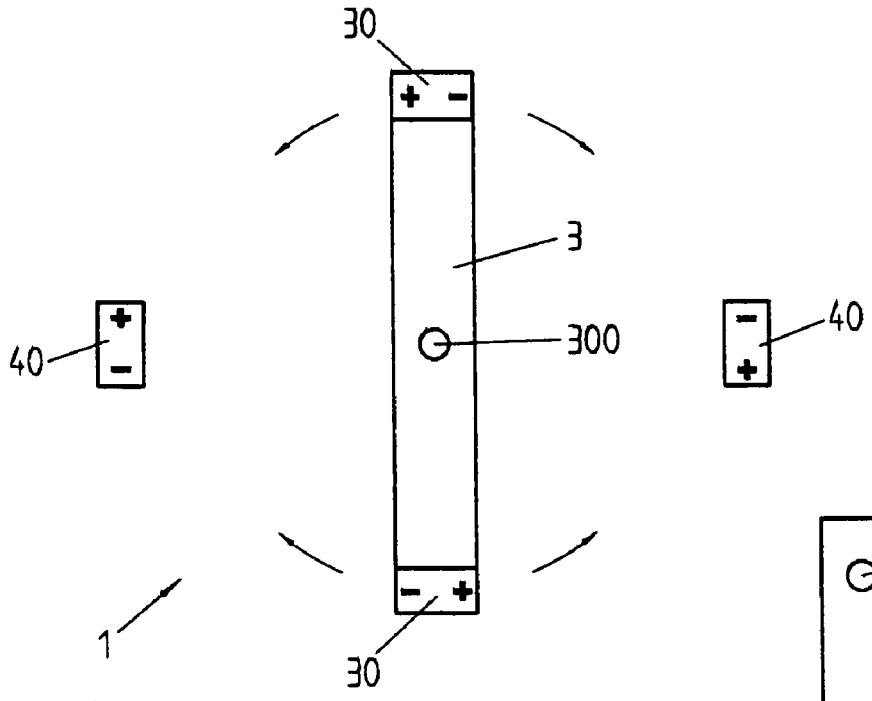
FIG. 6, a top view of an embodiment of a regulating member according to the invention, having a right balance pivoting around a central axle.

FIG. 6 illustrates in a simplified manner a variant embodiment of a regulating member according to the invention, having a right balance (needle-shaped) 3 pivoting around a central axle 300. The two extremities of the balance 3 are provided with magnets 30 pushed back towards the position of equilibrium by the fixed magnets 40 mounted on a bridge that is not represented. Although the inertia mass of the balance 3 in this embodiment is greatly reduced, this arrangement makes it possible to reduce the space requirements of the regulating member.

Figure 7:
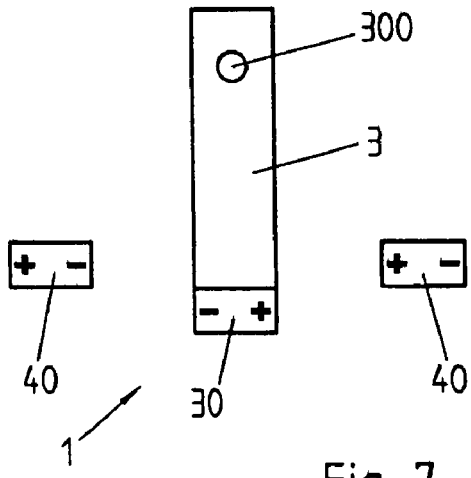
FIG. 7, a top view of an embodiment of a regulating member according to the invention, having a right balance pivoting around an eccentric axle.

FIG. 7 illustrates a top view of an embodiment of a regulating member according to the invention, having a right balance 3 similar to that of FIG. 6 but pivoting around an eccentric axle 300. Only the extremity of the balance 3 furthest from the axle 300 is provided in this embodiment with a magnet pushed back towards the illustrated position of equilibrium by means of two magnets 40.

In this embodiment, the escapement could be obtained by extending the balance 3 with a part in the shape of pallets directly actuated by the pallets wheel.

Apart from the right balances (needle-shaped or in 1) of the FIGS. 6 and 7, balances in T- or H-shape, for example, can easily be conceived.

Figure 8:
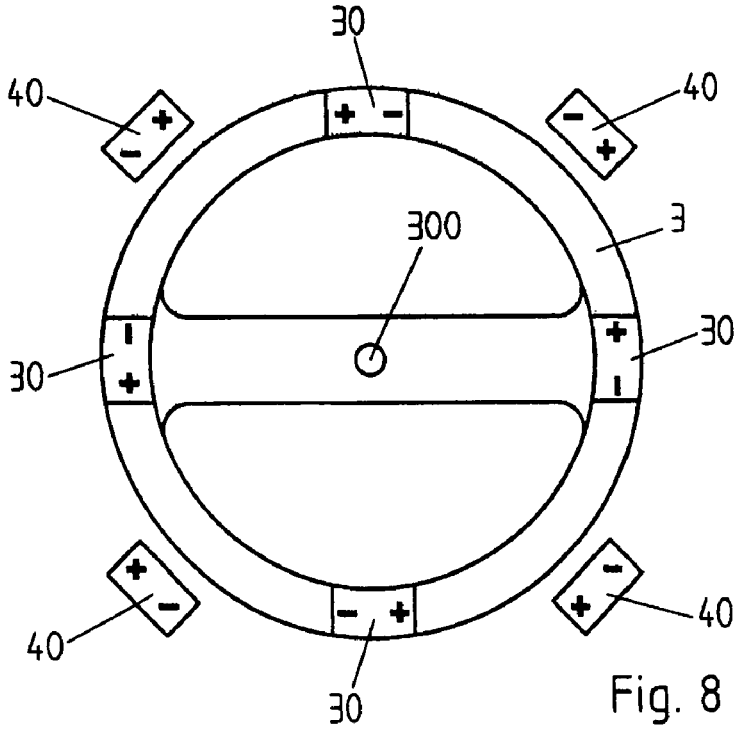
FIG. 8, a top view of an embodiment of a regulating member according to the invention, having four mobile magnets on the balance and four fixed magnets.

FIG. 8 illustrates a top view of a sixth embodiment of a regulating member according to the invention. The regulating member is similar to that of FIGS. 1 and 2, but has four mobile magnets 30 distributed at 90° to one another on a bridge that is not represented. This arrangement allows notably the distance between the fixed magnets and the mobile magnets to be reduced whilst multiplying the number of magnets, so that the resulting magnetic interaction force, and thus the return torque, are increased.

Arrangements having more than four mobile magnets and/or more than four fixed magnets can also be conceived. Furthermore, as mentioned, it is also possible to use magnetized parts with a plurality of zones of alternating magnetic polarities. A magnetic field alternated all-or-nothing or according to a sinusoidal function for example, can for example be written by a magnetic head on the periphery of the balance and/or on a fixed element connected to the movement.

Figure 9:
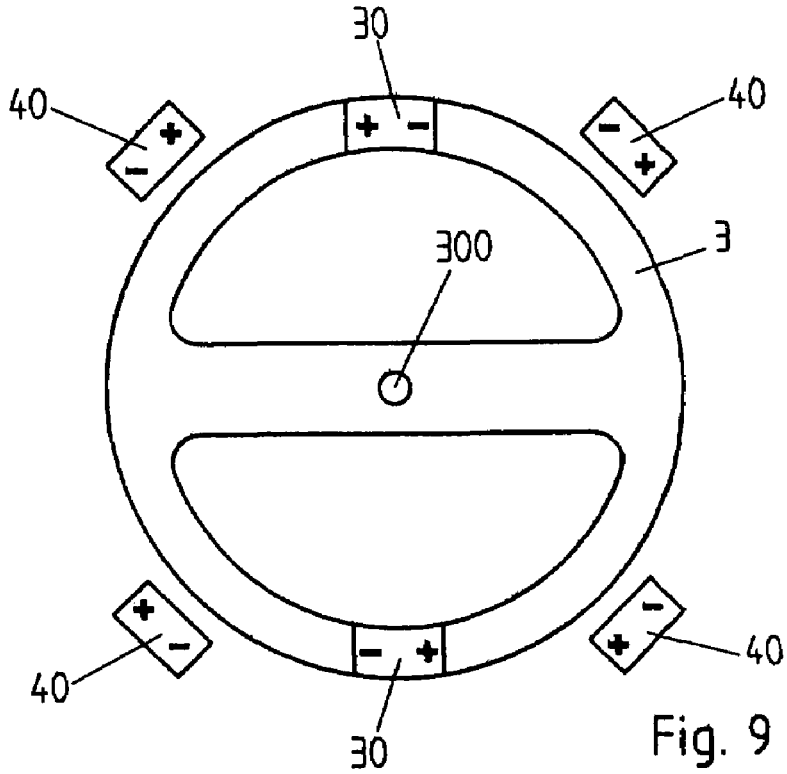
FIG. 9, a top view of an embodiment of a regulating member according to the invention, having two mobile magnets on the balance and four fixed magnets.

FIG. 9 illustrates a top view of an embodiment of a regulating member wherein the number of mobile magnets 30 on the balance is less than the number of fixed magnets 40. Each mobile magnet is thus subjected to the action of a pair of fixed magnets; each fixed magnet acts on only one mobile magnet. Arrangements having two fixed magnets and a single mobile magnet can also be conceived.

Figure 10:
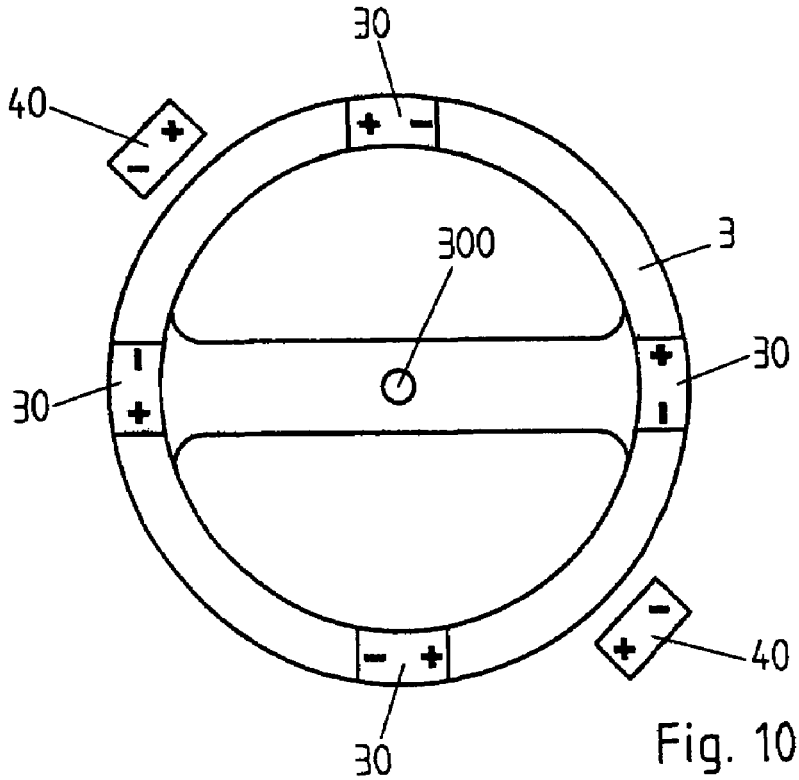
FIG. 10, a top view of an embodiment of a regulating member according to the invention, having four mobile magnets on the balance and two fixed magnets.

FIG. 10 illustrates a top view of an embodiment of a regulating member wherein the number of mobile magnets 30 on the balance is greater than the number of fixed magnets 40. Each mobile magnet is thus subjected to the action of a single fixed magnet; each fixed magnet however acts on two mobile magnets.

The amplitude of oscillations of the balance of FIG. 9 is very limited, less than 90°. It is thus possible to make it oscillate it very fast and to achieve a very fine resolution for measuring time. However, very fast oscillations of small amplitude have the disadvantage of amplifying the influence of perturbations caused at each cycle by friction with the pallets and the balance. According to the desired resolution and the quality in which the escapement is made, it can thus be desirable to increase the amplitude of the oscillations beyond 180° rather than seeking to reduce it. For this purpose, arrangements having two mobile magnets and a single fixed magnet are also possible, or even a single fixed magnet and a single mobile magnet that allow oscillations of nearly 360° to be achieved.

Furthermore, in an embodiment that is not illustrated, it is also possible to increase the rotating inertia mass by linking the balance 3 with another oscillating mass through a cinematic chain, for example a gearing on the balance's axle, or through a belt. The balance's oscillations are thus transmitted to an additional oscillating mass. Gear ratios between the balance 3 and the additional oscillating mass further make it possible to achieve a different amplitude of oscillation on these two components. It is for example conceivable to have the balance 3 oscillate by 180° and to connect it cinematically through a gear of ratio 8 to another rotating mass that completes oscillations of 8×180°, i.e. four turns, at each cycle.

Figure 11:
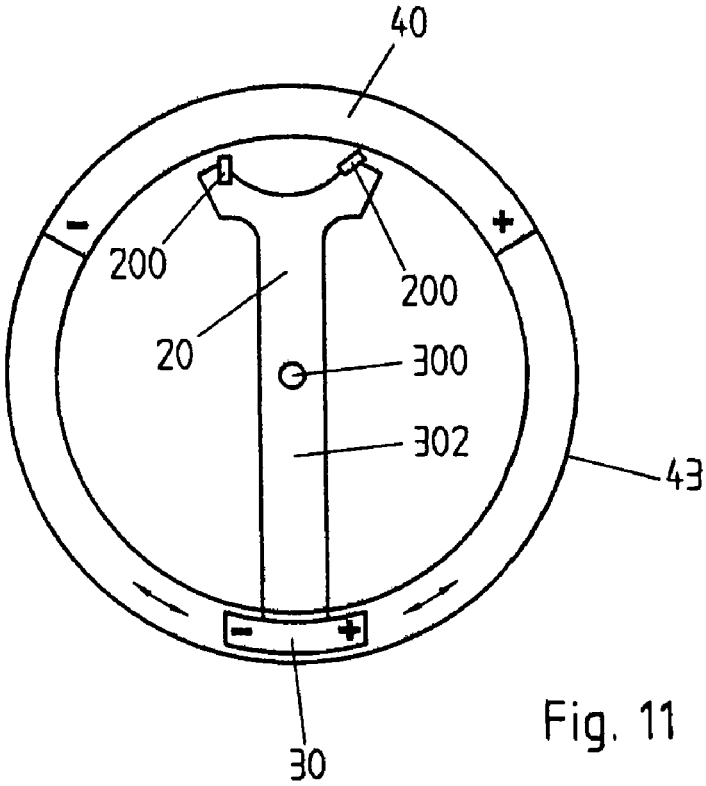
FIG. 11, a top view of an embodiment of a regulating member according to the invention, having a torque element in which a mobile magnet is pushed back towards a position of equilibrium by a fixed magnet.

FIG. 11 illustrates an embodiment of the invention wherein the balance is constituted by a mobile magnet 30 whose trajectory is constrained by a guide 43, for example a slide-way, a slide or a rail, in this example an o-ring slide-way. The arrangement of the poles of the fixed magnet 40 is opposed to the arrangement of the poles of the mobile magnet 30, so that the position of equilibrium is reached when the mobile magnet is diametrically opposite the fixed magnet. This arrangement makes it possible to use a single mobile magnet and a single fixed magnet. Different, not annular, shapes of slide-ways, rails or slides 43, can also be conceived; furthermore, the fixed magnet 40 could be outside the slide.

In this embodiment, the balance 30 is driven through the pallets 20 actuated by an escapement wheel that is not represented and that is articulated around the axle 300. The pallets 20 extend the balance's arm outside the slide 43. A magnetic escapement can also be used in the frame of the invention.

Arrangements of regulating members having several stable positions of equilibrium can also be conceived within the frame of the invention.

Figure 12:
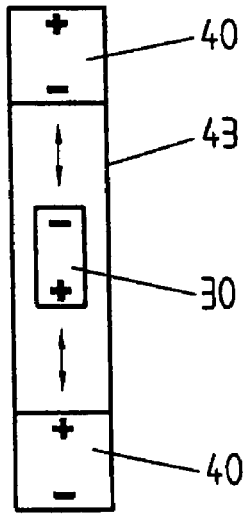
FIG. 12, a top view of an embodiment of a regulating member according to the invention, having a cylinder closed at its extremities by two fixed magnets as well as a mobile magnet pushed back to an intermediary position by the two fixed magnets.

FIG. 12 illustrates an embodiment of the invention wherein the balance 3 is constituted by or has a magnet 3 moving linearly in a cylinder, a slide-way or along a rail 43 whose two extremities are closed by fixed magnets 40. The polarities of the magnets 30 and 40 are placed in such a manner that the magnetic interaction force tends to push back the mobile magnet 30 in levitation half-way between the two fixed magnets 40, as illustrated in FIG. 12. The balance 3 can be made to oscillate by means of an element external to the rail 43 and following the movements of the balance 2 through a mechanical or magnetic connection.

The balance's movement in FIGS. 11 and 12 is constrained by the guides 43, which causes an energy loss and a loss of accuracy in the case of deformation or dilatation of the guiding surfaces. These embodiments however allow non-conventional solutions to be used to answer specific needs.

Balances oscillating in a plane along two or even degrees of freedom can also be conceived in the frame of the invention.

A plurality of fixed permanent magnets must in this case be provided for pushing back the balance towards a point of equilibrium around which a driving element makes it oscillate. However, the small thickness available in a wristwatch and the difficulties of making the escapement make such solutions more difficult to apply.

Figure 13:
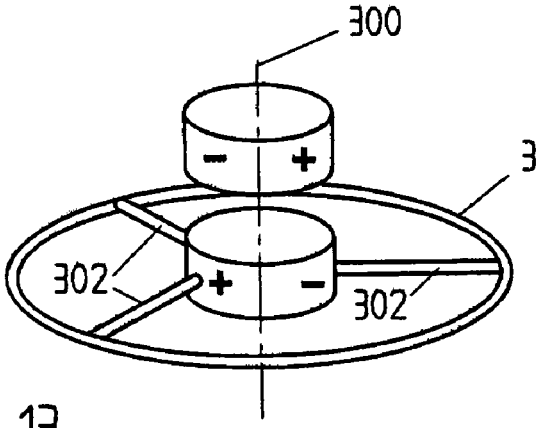
FIG. 13, a perspective view of an embodiment of a regulating member according to the invention, wherein the mobile magnets linked to the balance and the fixed magnets are superimposed, in two parallel planes, the regulating member being in a position of equilibrium.
Figure 14:
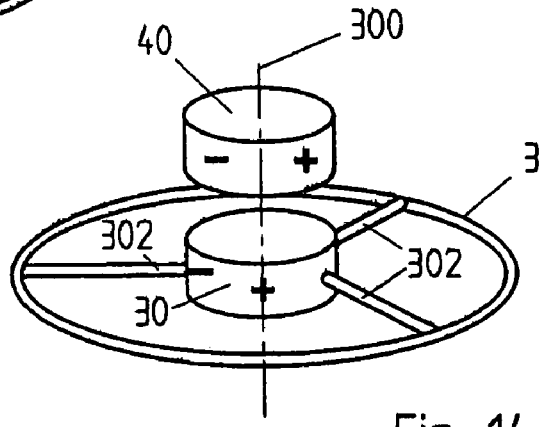
FIG. 14, a perspective view of the regulating member of FIG. 13, oscillating in an intermediary position.

FIGS. 13 and 14 illustrate an embodiment of the regulating member having a mobile magnet 30 constituted by a disc mounted at the center of the balance 3. The disk 30 has sectors, in the illustrated embodiment two sectors, provided with alternating magnetic polarities. The fixed magnet 50 is mounted above the mobile magnet 30, in a parallel plane, and also constituted by a disc provided with sectors of alternating polarities. In the position of equilibrium illustrated in FIG. 13, the balance is positioned so that the sectors of opposite polarity of the two magnets 30 and 40 are exactly superimposed. The balance is brought in this position essentially by attracting opposite poles of the two magnets and, in a lesser measure, by repulsion of the identical poles. The balance oscillates around this stable position of equilibrium when a perturbation is transmitted to it for example by the escapement, not represented in the figure.

It is also possible to modify the arrangement of the FIGS. 13 and 14 for example by using magnets 30 and 40 provided with more than two sectors of alternating polarities, or by using several fixed magnets in a first plane and several mobile magnets in a parallel plane. The mobile magnets can for example also be placed at the balance's periphery and the mobile magnets above these positions. It is also possible to use a different number of fixed magnets and mobile magnets; for example, it would also be possible within the frame of the invention to mount the mobile magnet 30 between a fixed magnet on an upper plane, as illustrated in the figures, and an additional fixed magnet, not represented, in a lower parallel plane.

Figure 15:
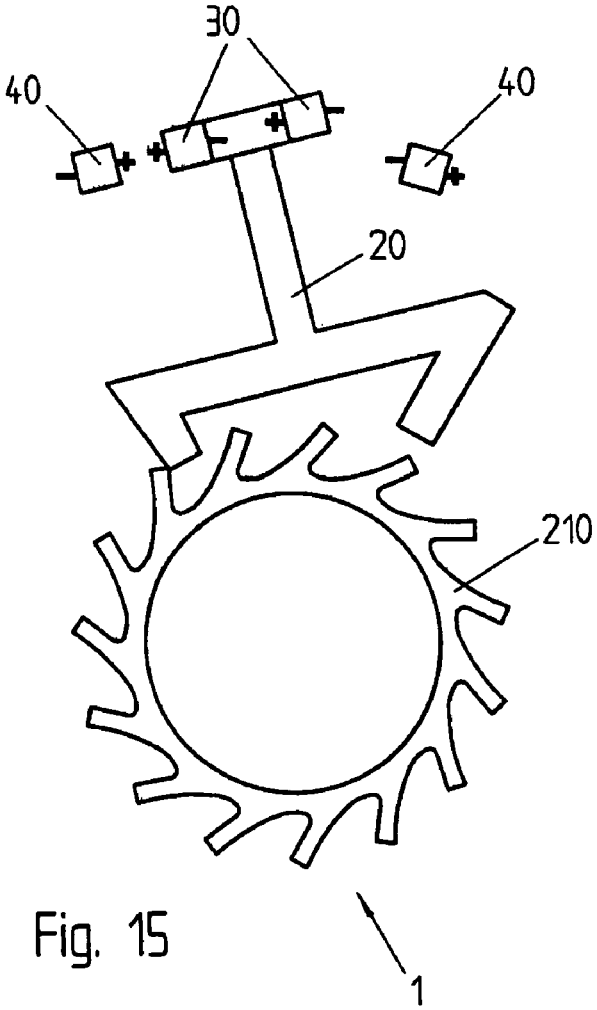
FIG. 15, a top view of an embodiment of a regulating member according to the invention, wherein the mobile magnets are directly mounted on the pallets that thus acts as balance.

FIG. 15 illustrates a top view of an embodiment of a regulating member wherein the mobile magnets 30 are directly mounted on the pallets 20. Fixed magnets 40 tend to push back and make oscillate these mobile magnets around a position of equilibrium. The pallets 20 themselves thus act as balance. This embodiment, although conceivable, has however the disadvantage of being more shock sensitive, the pallets' inertia being generally insufficient for guaranteeing an isochronous oscillation. Pallets with strong inertia would be conceivable but would require considerable excitation energy to make them oscillate.

Figure 16:
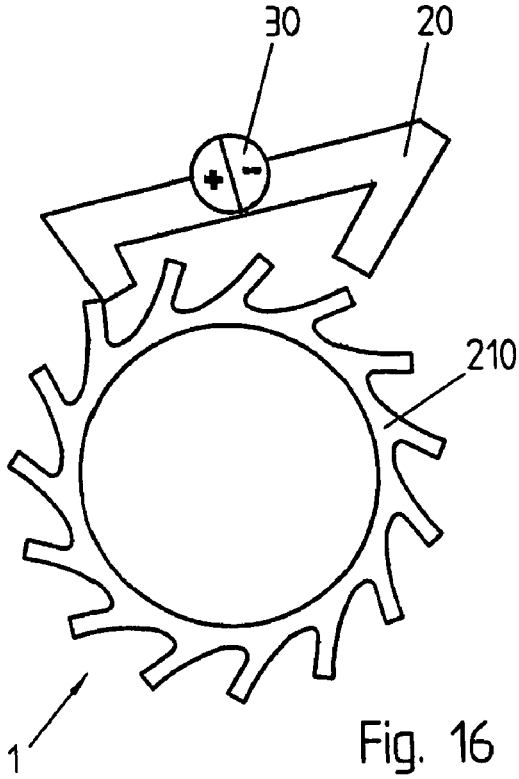
FIG. 16, a top view of an embodiment of a regulating member according to the invention, wherein the mobile magnets are directly mounted on the pallets that thus acts as balance, the fixed magnets being superimposed to the mobile magnets in a parallel plane.

The embodiment of FIG. 16 combines the characteristics of the solutions illustrated in FIGS. 13 and 15, i.e. pallets 20 acting themselves as balance and fixed and permanent magnets constituted by superimposed discs provided with sectors of alternating polarities.

Ordinary mechanical magnets have a return force proportional to their elongation d:

$$F=k\bullet d$$

Applied to a spiral spring design to return a balance towards its stable resting position, this force guarantees an isochronous oscillation when the balance's excitation, caused by the escapement, obeys certain constraints.

However, the return force between two punctual magnets decreases in a square or even cubic fashion when the distance d between the magnets increases:

$$F\cong j/d \text{ or } F\cong j/d^3$$

Used with a conventional escapement, this ratio guarantees a stable isochronous oscillation only when the oscillations satisfy very particular conditions (for example when their amplitude is low).

Figure 17:
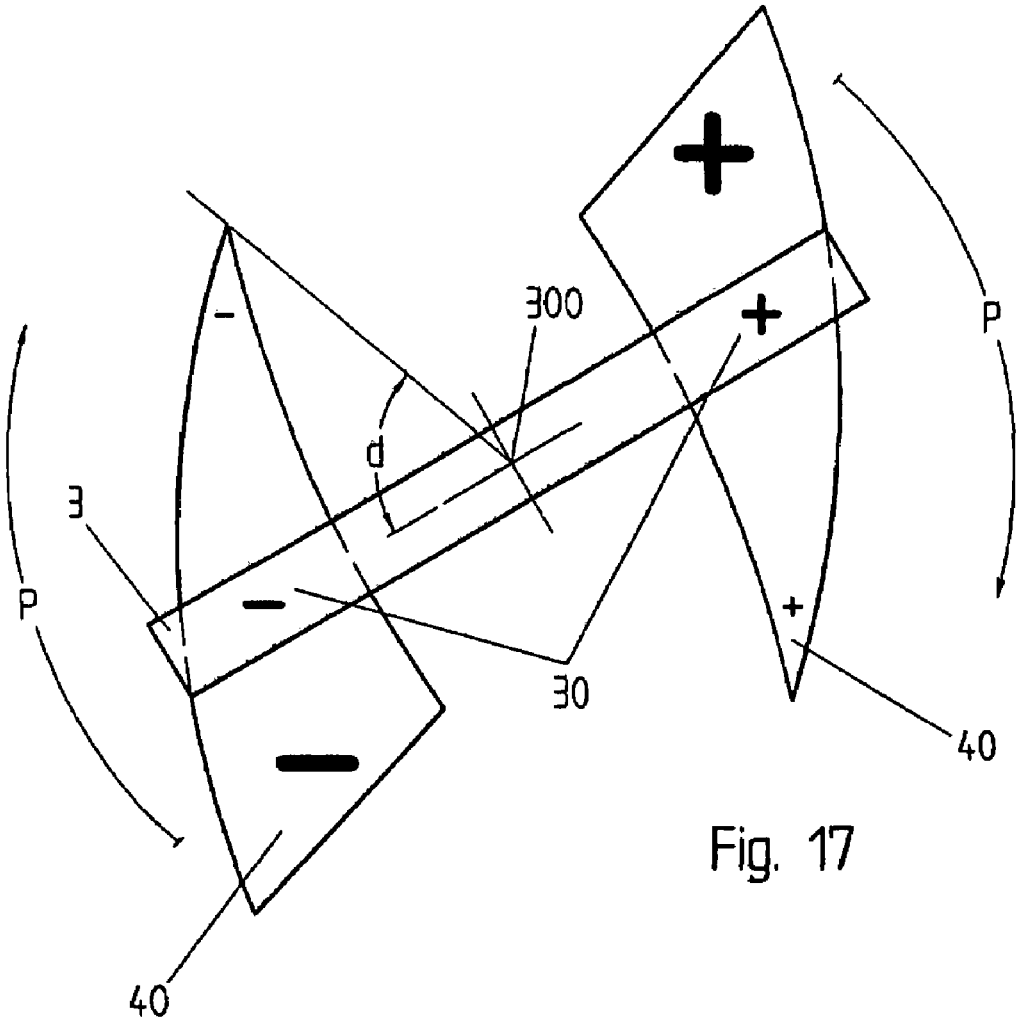
FIG. 17, a top view of an embodiment of a regulating member according to the invention, wherein the fixed magnets have a particular shape designed to guarantee a return force proportional to the angular distance, and wherein the balance has the shape of a rod.
Figure 18:
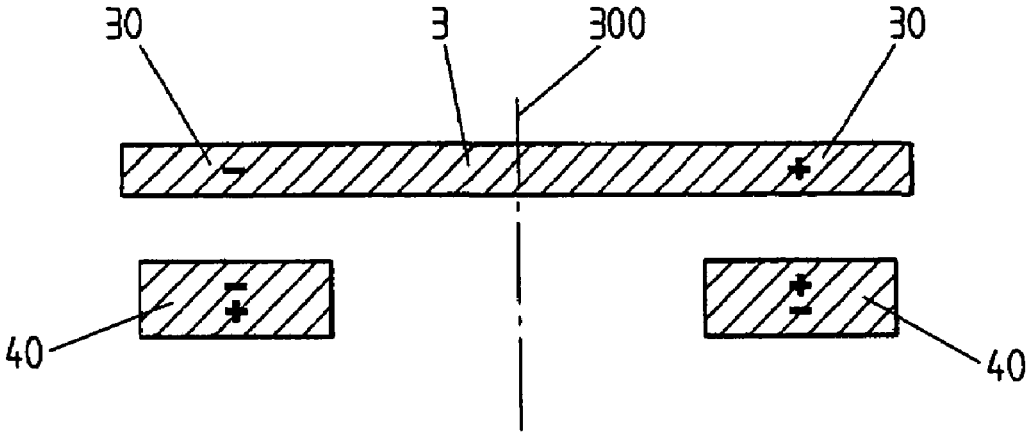
FIG. 18, a transversal cross section of the regulating member of FIG. 17 in the rod's plane.

The embodiment of FIG. 17 illustrates an embodiment of a regulating member wherein the ratio between the distance of the balance (i.e. its angular distance relative to the resting position 9 and the returning force or torque obeys a different ratio.

For this, the volume of the fixed magnets 40 increases when, within the oscillation range p, one moves away from the resting position by an angular distance d, so as to increase the return force at a distance from this position. The mobile magnets 30 on the balance 3 are on the other hand of constant size along the trajectory of the oscillations. Mechanical or magnetic stops, not represented, can be provided to force the balance to remain within the oscillation range p even in the case of shocks for example.

Thus, the escapement, not represented, tends to make the balance turn anticlockwise, a rotation that is countered by the magnets' repulsion.

Figure 19:
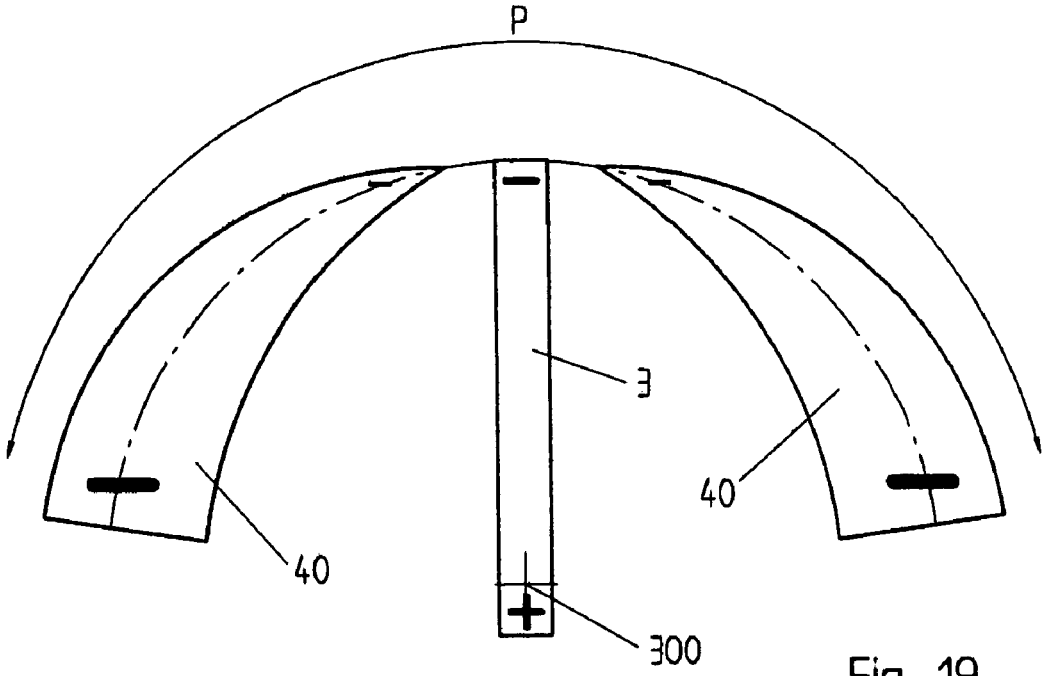
FIG. 19, a top view of another embodiment of a regulating member, wherein the return force is proportional to the angular distance.

In the embodiment of FIG. 17, the surface of the fixed magnets 40 in a plane parallel to the plane of the oscillations of the balance 3 increases inside the oscillation field p with the cube of the angular distance d, or possibly according to $d^4$. The fixed magnets 40 thus have the shape of sectioned moons. Another possible arrangement is illustrated on FIG. 19, wherein the balance oscillates around the axle 300 on each side of the resting position.

The mobile magnets 30 of FIG. 17 move along a circular trajectory in a plane parallel to the plane of the fixed magnets 40. It is however also possible, in order to increase the magnetic interaction, to have the mobile magnets turn between two parallel planes each provided with one or several fixed magnets 40. Conversely, it is also possible to provide a balance 3 composed of several superimposed pates, turning on a same axle and all provided with mobile magnets 30; the different mobile plates are then separated by one or several bridges bearing the fixed magnets. Other types of stacking of any number of planes of mobile magnets and of planes of fixed magnets can be conceived.

Other arrangements, not represented, are possible to correct the ratio between the return force caused by the magnets 30, 40 and the distance or angular distance of the balance 3 relative to the resting position. For example, instead of varying the surface of the fixed magnets in the horizontal plane, it is possible to very the surface of the mobile magnets. Moreover, it is also possible to modify the thickness of the fixed and/or mobile magnets, or their magnetization, along the balance's journey. These different measures can furthermore be combined with one another. Moreover, it is also possible to use magnets of variable volume or magnetization in a system having a circular balance with considerable inertia and/or to use an arbitrary number of fixed and/or mobile magnets of variable volume or density. Finally, a return force that varies according to the angular distance of the balance can also be achieved with discrete magnets of different size, material, and/or magnetization.

Figure 20:
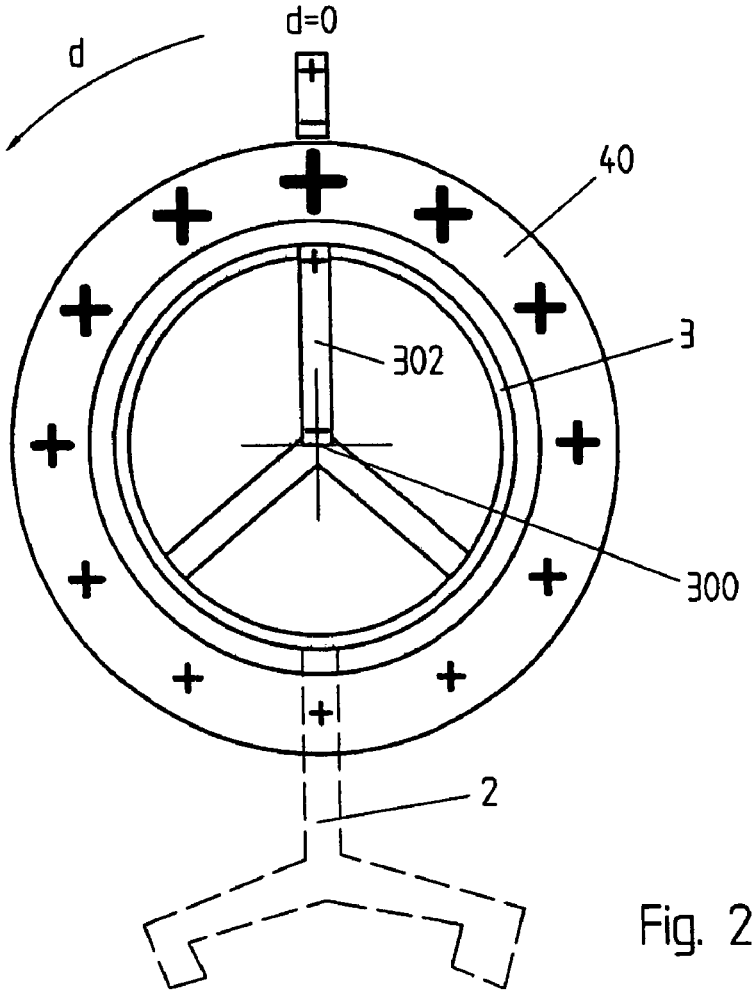
FIG. 20, a top view of another embodiment of a regulating member, wherein the return force is proportional to the angular distance, where this embodiment uses a magnetic ring with a magnetization that varies along the periphery.

FIG. 20 illustrates an embodiment of the invention wherein the balance 3 is provided with three spokes 302, of which at least one is magnetized with opposed poles at each radial extremity. Thus, only the external pole of the spoke exerts a significant interaction with the fixed magnets 40, which are constituted by a magnetic ring 40 with a polarization in one direction inside and in the opposite direction outside. Furthermore, the magnetization of the fixed magnet 40 increases, preferably by $d^3$ or possibly $d^4$, with the angular distance d relative to the resting position d=0 of the balance. The density of the magnetic field generated by the fixed magnet varies along the balance's periphery so as to preferably ensure a return force that varies linearly with the balance's angular position. In an embodiment that is not illustrated, the balance could also be provided with a magnetic peripheral ring or of discrete magnets on the periphery, with a magnetization that varies along the periphery.

The progressive magnetization of the fixed magnet can for example be obtained by magnetizing it by means of a recording head, as previously mentioned. In case the magnetic material is saturated, it may be necessary to limit the balance's oscillations in the portion that guarantees the desired ratio between the balance's angular position and the return force. Furthermore, instead of magnetizing the entire balance, it would be conceivable to magnetize only a magnetic path fastened onto the latter, in parallel or perpendicularly to the plane of the balance.

An additional fixed permanent magnet 47 is place opposite the mobile magnet 30 at the maximum repulsion position, in order to prevent the balance from reaching and then overshooting this position. This magnet 47 thus acts as magnetic stop to move the balance away from a non-desirable position of equilibrium, without having the disadvantages of mechanical stops causing shocks likely to disturb the isochronous running of the balance.

In the case where the balance's oscillations are less than 180°, it would also be possible and even preferably to provide magnetic stops 47, not illustrated, closer to the balance's end of travel, for example a stop at 10 o'clock and a second stop at 2 o'clock in order to push the balance back well before it reaches the undesirable instable position of equilibrium at 12 o'clock.

On the embodiment of FIG. 20, the permanent magnets are constituted by a continuous ring. It is however also possible to use a discontinuous ring, for example provided with one or several head gaps or having discrete magnets.

In the embodiments of FIGS. 17 to 20, the volume of the fixed (and/or mobile) magnets thus varies in a continuous manner along the balance's circular trajectory, so as to control the ration between the return force and the balance's angular position.

Figure 21:
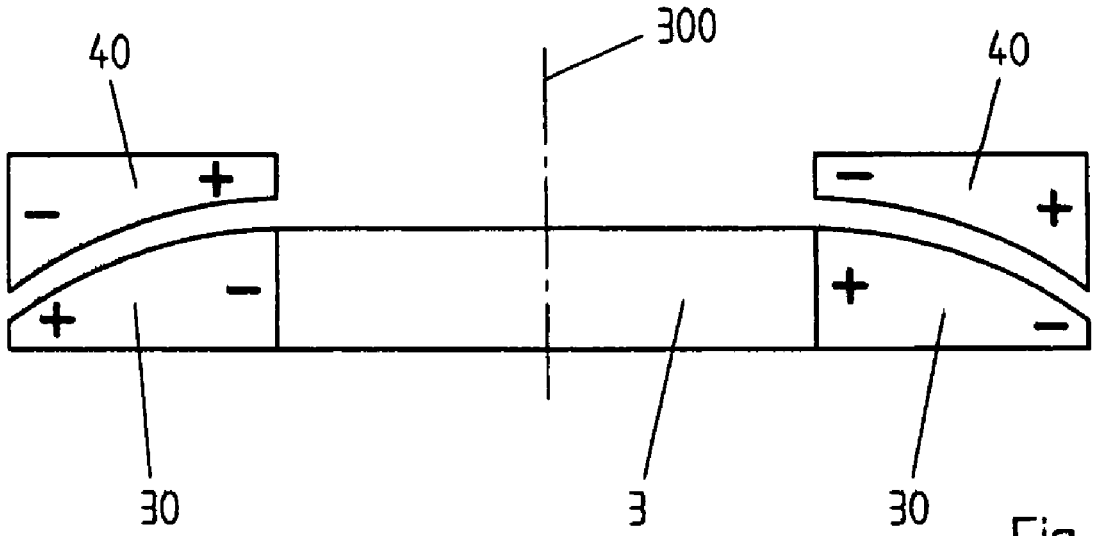
FIG. 21, a cross-sectional view of an embodiment of a regulating member according to the invention, having magnets of a thickness that varies radially.
Figure 22:
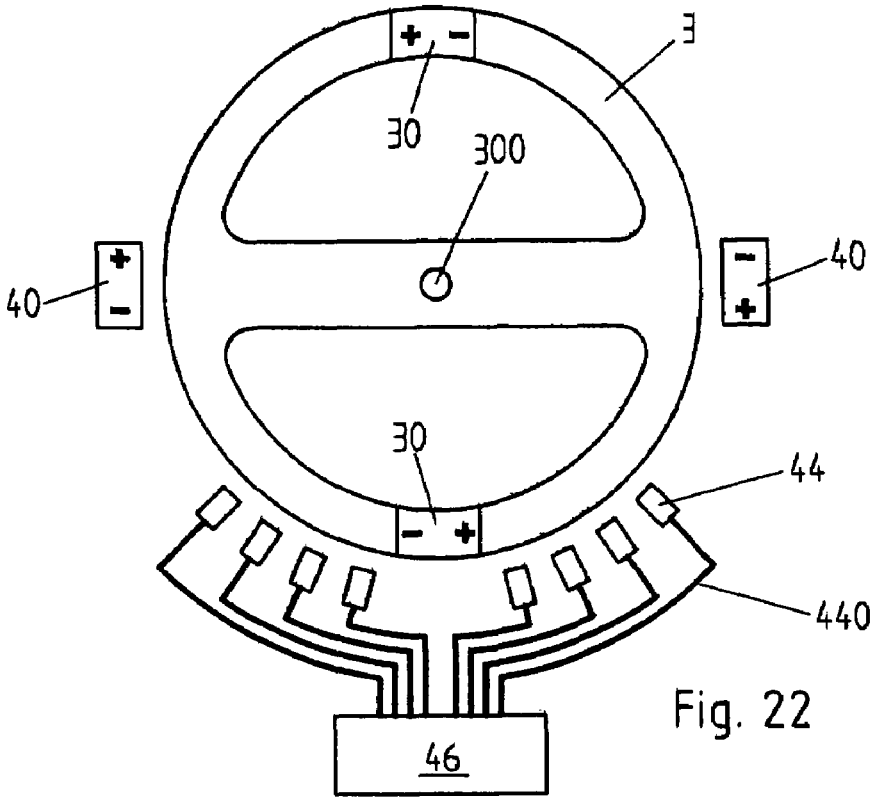
FIG. 22, a top view of an embodiment of a regulating member according to the invention, corresponding to the first embodiment but wherein a sensor and a circuit allow the amplitude of the balance's oscillations to be determined and/or controlled.

FIG. 21 illustrates an embodiment of the invention wherein the thickness of the mobile magnets 30 increases radially whilst the thickness of the fixed magnets 40 diminishes by moving away from the rotation axle 300. An inverted arrangement, providing a gap between the fixed and mobile magnets, can also be adopted. Furthermore, the radial thickness variation can also be combined with a variation along the periphery of the regulating member. The radial and/or circumferential variation in the thickness of the magnets 30, 40 can also be used with the embodiments of FIGS. 13 and 14 having superimposed magnets. Furthermore, it is also possible to vary the magnetization of the fixed and/or mobile magnets according to the distance to the center.

FIG. 33 illustrates an embodiment of the regulating member illustrated in FIGS. 1 to 2, and furthermore has a plurality of electrodes 44 whose electric property varies according to the electric field to which they are subjected. The electrodes 44 thus allow the turning magnetic field generated by the oscillations of the mobile magnets 30 to be detected or even measured. The electrodes 44 can for example be constituted by magnetoresistive electrodes or by Hall sensors. They can be connected to one another and to an integrated circuit 46 through conducting paths 440 according to different topologies. The circuit 440 allows the amplitude of the oscillations of the balance 430 and/or the oscillation frequency to be determined. The circuit 46 can be powered by an independent energy source, for example a battery, or by a coil generating an alternating current under the action of the balance's displacements, as illustrated in connection with FIG. 18 mentioned further above. An electronic correction of the running of a mechanical watch can thus be achieved.

Measuring the frequency and/or amplitude of the oscillations of the balance 30 allows for example possible irregularities in the running frequency to be detected. This information can be used to correct the watch's running, for example by exerting a correction torque on the balance 30 by means of electro-magnets, not represented, or by other electro-mechanical means, so as to correct the amplitude and frequency of the oscillations. This information can also be used for displaying an end-of-travel signal, so as to signal to the user that the watch's running is becoming inaccurate.

Figure 23:
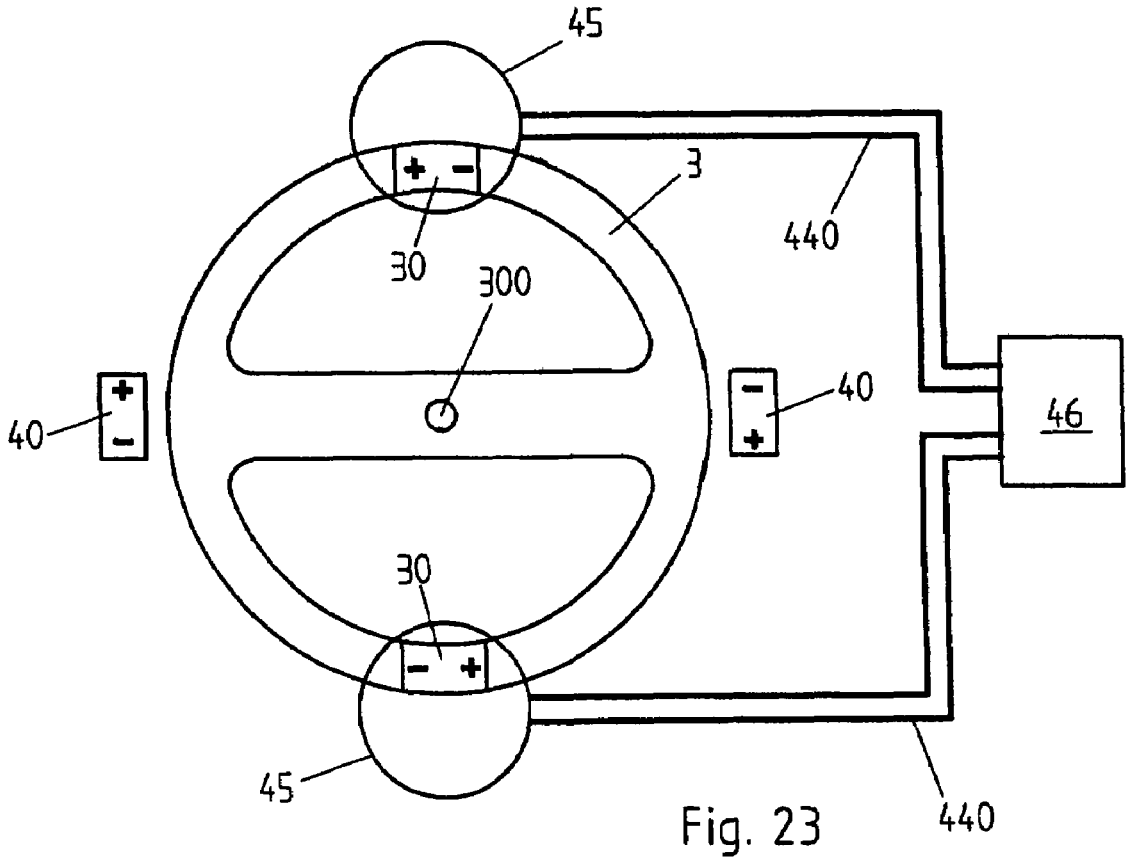
FIG. 23, a top view of an embodiment of a regulating member according to the invention, corresponding to the first embodiment but wherein a coil generates a current whose frequency depends on the balance's oscillation frequency.

FIG. 23 illustrates an embodiment of the regulating member wherein a coil 45 opposite each mobile magnet 30 generates a current proportional to the magnetic field generated when this magnet moves close to the coil. Arrangements having two coils of opposing phase, or three coils generating a three-phased current system, can also be used. The illustrated coils generate an approximately sinusoidal current whose frequency corresponds to the balance's oscillation frequency. This frequency can be measured by a circuit 45, for example by comparing it to a reference frequency supplied by a quartz, in order for example to inform the user in case of irregular frequency and/or to correct this frequency, for example by injecting a compensation current into the coil 45. The circuit 46 can include a rectifier and thus be powered itself by the current generated by the coil 45. The current generated by the coil can also be used to power a circuit supplying any type of function one wishes to give a mechanical watch without battery.

The described regulating member can be used in a movement for autonomous wristwatch or in an auxiliary module, for example a chronograph module, designed to be superimposed to a basis module.

The different regulating members described all have at least one mobile permanent magnet and at least one fixed permanent magnet. Constructions without fixed permanent magnet or without mobile permanent magnet can however be conceived in the frame of the invention.

The inventive regulating member is preferably mounted in a mechanical movement, preferably without a battery, and in a watch-case that shows at least part of the balance, which allows the user to check its displacements at any time.

The invention claimed is:

1. Regulating member for mechanical wristwatch, having:

a balance, a return member for returning said balance towards at least one position of equilibrium, a driving element for maintaining the balance's movement around said position of equilibrium, wherein said balance is linked to at least one mobile permanent magnet, and wherein said return member has at least one fixed permanent magnet for generating a magnetic field in order to return said balance towards said position of equilibrium.

2. The regulating member of claim 1, wherein said balance has a rotation axle, said at least one mobile permanent magnet oscillating along a circular trajectory around said rotation axle.

3. The regulating member of claim 1, wherein said fixed magnets are distributed on an arc of circle.

4. The regulating member of claim 3, wherein at least one said mobile magnet oscillates along a circular trajectory between two fixed magnets spaced angularly by less than 180° on said arc of circle.

5. The regulating member of claim 1, wherein said movement of the balance is constituted by oscillations around the balance's rotation axle, the amplitude of said oscillations being less than 180°.

6. The regulating member of claim 1, wherein said movement of the balance is constituted by oscillations around the balance's rotation axle, the amplitude of said oscillations being greater than 180° and preferably less than 300°.

7. The regulating member of claim 1, wherein said driving element is constituted by an escapement to transmit the circular oscillations from the balance to the rest of the movement.

8. The regulating member of claim 1, wherein said return member acts on said balance without matter deformation.

9. The regulating member of claim 1, wherein said return member acts without contact with said balance.

10. The regulating member of claim 1, wherein said magnetic field is constant in time.

11. The regulating member of claim 1, wherein at least one said fixed magnet is placed so as to push back at least one said mobile magnet towards said position of equilibrium.

12. The regulating member of claim 1, wherein the magnetic interaction between said at least one fixed magnet and said at least one mobile magnet is minimal at said position of equilibrium.

13. The regulating member of claim 1, wherein said position of equilibrium is determined by the action of at least two fixed magnets acting on at least one same mobile magnet.

14. The regulating member of claim 13, wherein, at the position of equilibrium, the magnetic fields exerted by the two said fixed magnets onto said at least one same mobile magnet are of equal intensity.

15. The regulating member of claim 13, wherein said mobile magnet is at equidistance between two fixed magnets at said position of equilibrium.

16. The regulating member of claim 1, wherein said position of equilibrium is determined by the action of at least one fixed magnet acting simultaneously on at least two mobile magnets.

17. The regulating member of claim 1, wherein said position of equilibrium is a stable position of equilibrium in which the magnetic attraction between the fixed magnets and the mobile magnets is minimal.

18. The regulating member of claim 1, having the same number of mobile magnets as fixed magnets.

19. The regulating member of claim 1, wherein, at the position of equilibrium:

each fixed magnet exerts a magnetic field of equal intensity on two mobile magnets, and each mobile magnet exerts a magnetic field of equal intensity on two fixed magnets.

20. The regulating member of claim 1, wherein said mobile magnet or magnets are fixed relative to said balance.

21. The regulating member of claim 20, wherein said balance is symmetrical relative to said rotation axle.

22. The regulating member of claim 20, wherein said mobile magnets are placed in symmetric fashion around said rotation axle.

23. The regulating member of claim 1, having mechanical and/or magnetic stops to limit the amplitude of possible rotations of said balance.

24. The regulating member of claim 1, wherein said balance is constituted by a mobile permanent magnet.

25. The regulating member of claim 1, wherein said at least one mobile permanent magnet is linked to the pallets that thus also constitute the balance.

26. The regulating member of claim 1, wherein said at least one mobile permanent magnet is mounted in the plane of the balance and wherein said at least one fixed permanent magnet is mounted in a plane parallel to said balance.

27. The regulating member of claim 26, wherein said at least one fixed permanent magnet and said at least one mobile permanent magnet are each constituted by a disc having sectors of alternating polarities.

28. The regulating member of claim 1, having means for compensating the variation of magnetic field linked to the temperature.

29. The regulating member of claim 1, wherein said driving element is constituted by a mechanical escapement, for example a Swiss pallets escapement.

30. The regulating member of claim 1, wherein said escapement is a magnetic escapement.

31. The regulating member of claim 1, said balance being held by at least one magnetic bearing.

32. The regulating member of claim 1, the position of said at least one magnet being adjustable for regulating the frequency of the oscillations of said balance.

33. The regulating member of claim 1, at least one said magnet acting on an electronic system to correct or determine the frequency of oscillation of said balance.

34. The regulating member of claim 33, said electronic system having at least one Hall sensor or a magnetoresistive sensor subjected to the action of the magnetic field of one of the magnets to generate a measuring signal depending on the oscillations of said balance.

35. The regulating member of claim 33, said electronic system having at least one coil subjected to the action of the magnetic field of one of the mobile magnets to generate a signal depending on the oscillations of said balance.

36. The regulating member of claim 33, having at least one electronic circuit powered by the electro-motor force generated by the displacement of one of said magnets in the proximity of a coil.

37. The regulating member of claim 1, having east least one bridge made of a non-magnetic material.

38. The regulating member of claim 1, having a magnetic screen in order to protect external elements from the magnetic field generated by said permanent magnets.

39. The regulating member of claim 1, wherein the displacements of said balance are constrained by a guiding surface.

40. The regulating member of claim 1, wherein the return force of said balance varies linearly with the angular position of the balance.

41. The regulating member of claim 1, wherein said balance moves along a circular trajectory, the volume of the fixed and/or mobile magnets and/or their magnetization varying in continuous manner along said trajectory.

42. The regulating member of claim 41, wherein said balance oscillates around a position of equilibrium along a circular trajectory, the magnetic interaction between said fixed permanent magnets and said mobile permanent magnets increases when the balance moves away from said position of equilibrium along said trajectory, so as to achieve an increasing return force.

43. The regulating member of claim 1, wherein at least one of said fixed and/or mobile permanent magnets is magnetized in non-homogenous manner.

44. The regulating member of claim 1, wherein said balance is constituted of several oscillating elements connected by a cinematic chain and oscillating with variable frequencies.

45. Mechanical movement for wristwatch having a regulating member according to claim 1.

46. Movement according to claim 45, wherein the cinematic chain between said regulating member and the display elements has at least one belt of non-magnetic material.

47. Movement according to claim 45, wherein at least one portion of said balance is visible from outside the movement.

48. Regulating member for mechanical wristwatch, having:

a balance, a return member for returning said balance towards at least one position of equilibrium, a driving element for moving the balance away from said position of equilibrium, said balance being associated with at least one mobile permanent magnet, said return member comprising one or several fixed permanent magnet collaborating with said mobile permanent magnet.

49. Regulating member for mechanical wristwatch, having a balance with at least one mobile magnet cooperating with at least one fixed magnet for returning said balance towards at least one position of equilibrium, said at least one mobile magnet and said at least one fixed magnet being arranged so that the attraction force of said balance is linearly proportional to a distance between said mobile magnet and said fixed magnet.

* * * * *